US005572852A

United States Patent [19]

Crystal et al.

[11] Patent Number: 5,572,852

[45] **Date of Patent: *Nov. 12, 1996**

[54] METHOD FOR OPENING, REFILLING AND SEALING A CARTRIDGE

[76] Inventors: Richard G. Crystal, 1091 Nottingham Way, Los Altos, Calif. 94024; Sven Karlsson, 5369 Roxanne Dr., San Jose, Calif. 95124

[ * ] Notice: The term of this patent shall not extend beyond the expiration date of Pat. No. 5,400,573.

[21] Appl. No.: 413,127

[22] Filed: Mar. 24, 1995

Related U.S. Application Data

[63] Continuation of Ser. No. 166,718, Dec. 14, 1993, Pat. No. 5,400,573.

[51] Int. Cl.[6] ..... B65B 3/00; B65B 7/28; B65B 43/40; B67B 1/00

[52] U.S. Cl. ..... 53/428; 53/468; 53/489

[58] Field of Search ..... 53/468, 328, 319, 53/331.5, 359, 367, 489, 282, 428; 141/370, 391, 346–349; 347/85–87

[56] References Cited

U.S. PATENT DOCUMENTS

| | | | |
|---|---|---|---|
| 1,473,342 | 11/1923 | Goldman . | |
| 3,057,131 | 10/1962 | McKinley et al. | 53/88 |
| 3,457,694 | 7/1969 | Tatibana | 53/289 X |
| 3,590,557 | 7/1971 | Vogel | 53/289 X |
| 3,625,786 | 12/1971 | Pearson et al. | 53/289 X |
| 3,831,240 | 8/1974 | Boggs et al. | 29/148.3 |
| 3,973,603 | 8/1976 | Franz | 53/289 X |
| 4,338,765 | 7/1982 | Ohmori et al. | 53/289 X |
| 4,500,895 | 2/1985 | Buck et al. | 346/140 R |
| 4,597,245 | 7/1986 | Parker | 53/510 |
| 4,867,315 | 9/1989 | Baldwin | 206/558 |
| 5,027,872 | 7/1991 | Taylor et al. | 141/347 |
| 5,040,001 | 8/1991 | Dunn et al. | 346/140 R |
| 5,060,453 | 10/1991 | Alberghini et al. | 53/289 X |
| 5,199,470 | 4/1993 | Goldman | 141/1 |

FOREIGN PATENT DOCUMENTS

0519664A2 12/1992 European Pat. Off. .

*Primary Examiner*—Horace M. Culver
*Attorney, Agent, or Firm*—Lappin & Kusmer LLP

[57] ABSTRACT

A kit for opening and sealing a cartridge having an interior ink reservoir coupled to an access port extending from a reference surface comprises a rigid plunger, a plate and a rigid spherical plug. The plate has one or more regions of varying thickness and a bottom surface which is complementary to the reference surface on the cartridge. The bottom surface of the plate may be matched to the reference surface of the cartridge in two distinct orientations such that a sealed access port may be opened, refilled and sealed with a rigid spherical plug by extension of the plunger through the plate in each orientation to a depth determined by the length of the plunger, the thickness of the plate in each orientation, the depth of the access port in the cartridge, and the diameter of the spherical plug.

2 Claims, 7 Drawing Sheets

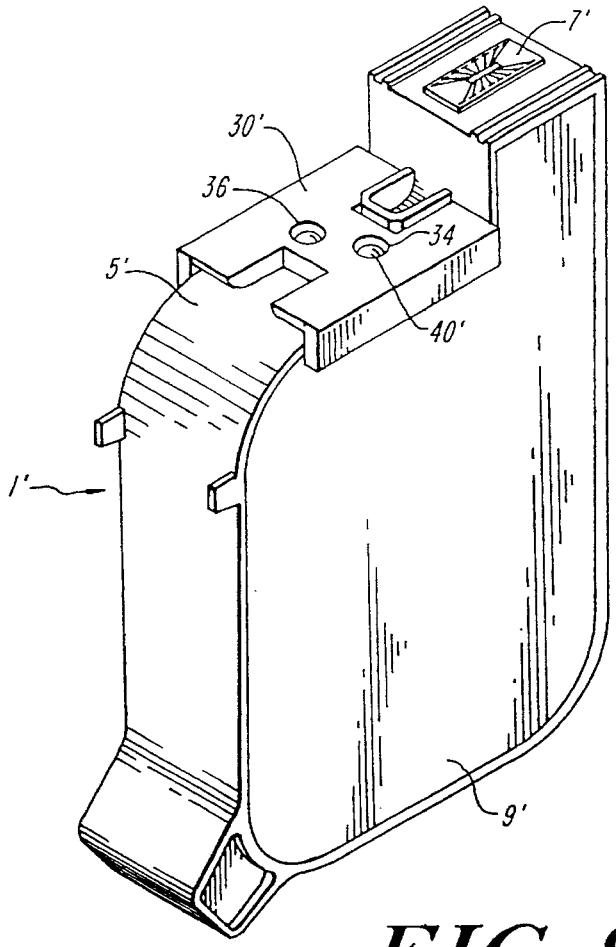
FIG. 9
FIG. 10
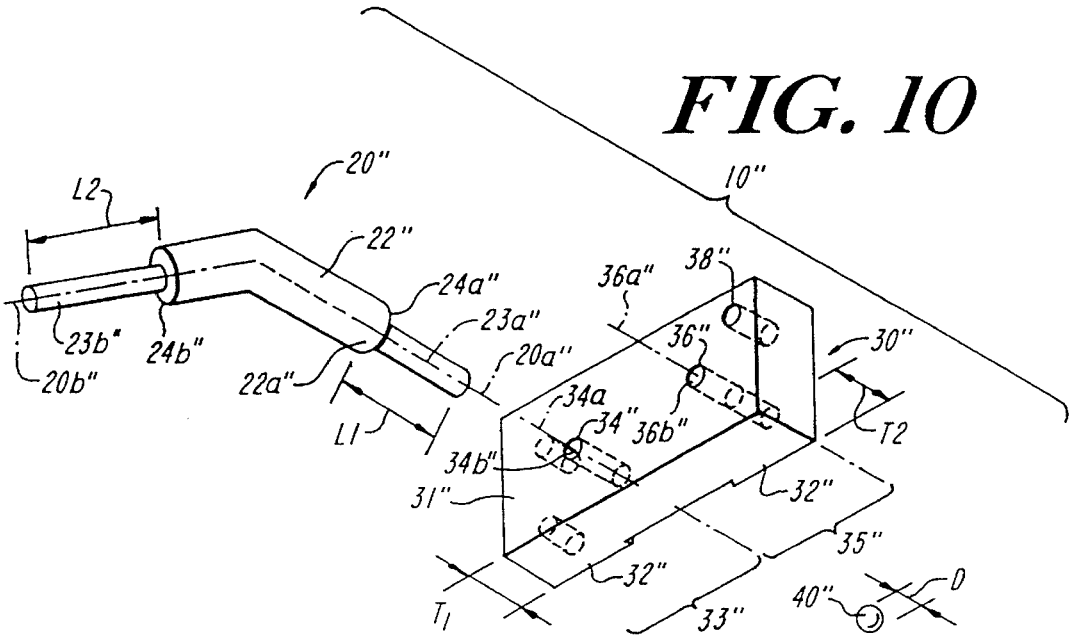

METHOD FOR OPENING, REFILLING AND SEALING A CARTRIDGE

This application is a continuation of patent application Ser. No. 08/166,718, entitled "Kit and Method For Opening, Refilling and Sealing a Cartridge", filed on Dec. 14, 1993 and now U.S. Pat. No. 5,400,573.

TECHNICAL FIELD

The invention relates generally to devices and methods for refilling cartridges of the type used in ink jet printers, and particularly to devices and methods for opening, refilling and sealing such cartridges.

BACKGROUND OF THE INVENTION

Modern ink jet printers employ a variety of ink cartridges for dispensing ink in a variety of colors. Upon depletion of the ink from a cartridge, the spent cartridges may generally be easily removed and disposed of and a new ink cartridge inserted in its place. Alternatively and more economically, the depleted ink cartridges may be removed, refilled with ink and replaced into the printer.

Various schemes have been developed to refill a depleted ink jet printer cartridge. For example, in U.S. Pat. No. 5,199,470 to Goldman, assigned to the assignee of the instant invention, a method and apparatus for refilling ink cartridges is disclosed. The apparatus comprises a kit including a device for clearing a hole in the ink cartridge to receive the new ink, and an ink injection bottle. U.S. patent application Ser. No. 086,620, filed on Jul. 1, 1993 and assigned to the assignee of the instant invention, discloses a method for refilling ink jet cartridges wherein the cartridge has an air port and an ink fill aperture and which have an expandable bladder and a bubble generator which act to equalize pressure within and without the cartridge so as to prevent leaking of ink from the cartridge. In accord with the disclosed method of the '620 application, the air port and ink fill aperture are respectively sealed and opened to receive a charge of ink therein. Once filled, the ink fill aperture of the cartridge is then sealed and the air port opened to equalize pressure within the cartridge.

Various seals are employed in ink cartridges to close the ink access ports during use and after refilling. Some cartridges utilize a rigid (e.g. metal) sphere within a compliant channel (such as the Hewlett Packard HP51640 and HP51650 cartridges), some utilize a compliant sphere within a rigid channel (such as the Hewlett Packard HP51604A and HP92261A cartridges), some utilize a compliant plug in a compliant channel (such as the Hewlett Packard HP51626A cartridge), and some utilize a rigid ball in a rigid channel with a retaining lip (such as that used with the Canon BJC600 printer). Moreover, some cartridges after a prior refilling operation utilize a (rigid or compliant) setscrew in a (compliant or rigid) channel. In all of these cases, when the ink supply is depleted from the cartridge, the plug can be removed from the channel, and the cartridge can be refilled, with the channel then being re-sealed. In the prior art it has, however, been difficult to remove the sealing element, without damaging the cartridge, and has been difficult to re-seal the cartridge, since there are no previously known kits and techniques for easily accomplishing the opening and precision re-sealing of the channel.

A disadvantage of using a cartridge having a setscrew plug is that the cartridge may not easily be reused, since the setscrew plug is difficult to remove without a specially adapted tool and is even more difficult to replace properly in the cartridge after refilling.

It is thus an object of this invention to provide a kit for opening, filling, and re-sealing a depleted cartridge employing a plug, so that the depleted cartridge could be refilled with ink and reused instead of discarded.

It is another object of the invention to provide a kit for opening and sealing a cartridge which would ensure proper placement of a seal in an ink access port of the cartridge and thus ensure against leakage of ink from the cartridge.

It is another object of the invention to provide a method for opening, refilling and resealing a cartridge upon depletion of ink therefrom, so that the cartridge may be recycled instead of discarded after a single use.

SUMMARY OF THE INVENTION

These and other objects of the invention are achieved by the present invention which, in one aspect, provides a kit for opening and sealing a cartridge having an interior ink reservoir coupled to a sealable access port in a cartridge wall. The access port has a nominally circular cross-section of diameter D and a nominally cylindrical wall which extends a distance d from an exterior reference surface of the cartridge into the interior ink reservoir along a port axis preferably perpendicular to the reference surface with a plug in the channel for sealing. The reference surface may contain one or more alignment keys. The sealing assembly of the cartridge may be of the type having a compliant plug/rigid channel, rigid plug/compliant channel, compliant plug/compliant channel, or rigid plug/rigid channel configuration. The invention may also be used without using a preformed access port; in such cases, an access port may be formed by a user drilling a hole in the reference surface, establishing an access port.

The kit comprises a plunger, a plate and a plug, typically spherical, although other shapes may be used. The plunger has a shank, the shank extending along a plunger axis to a shoulder, which has a cross-section with a maximum dimension greater than D. An elongated member extends along the plunger axis a distance L1 from the shoulder and has a cross-section with a maximum dimension less than or equal to D. The plate has top and bottom surfaces, a thickness $T_1$ in a first region, and a channel extending through the first region. Preferably, that channel has a circular cross-section with diameter D at the bottom surface. The spherical plug has a circular transverse cross-section at its widest point with a diameter equal to or slightly greater than D.

Preferably, the bottom surface of the plate is complementary to the reference surface (and the alignment keys, if present) of the cartridge in a first orientation such that the channel in the first region of the plate overlies the access port in the cartridge when the bottom surface of the plate is matched with the reference surface and alignment keys of the cartridge. In other forms, the bottom surface may not be complimentary to the reference surface, but merely permit placement thereof with the respective channels aligned.

Where the plug is spherical, the length L1 of the elongated member of the plunger exceeds the thickness of the first region $T_1$ minus half the diameter D of the spherical plug and is less than the sum of first thickness $T_1$ and the distance d along which the port extends into the cartridge, minus half the diameter D of the spherical plug. With this configuration, as described fully below, the plunger may be used to set the spherical plug in the access port following refilling of the reservoir, thereby resealing the refilled cartridge. With other shaped plugs, the length L1 is selected, in conjunction with T1, so that the same functional relationship exists.

In another form, the invention provides for a kit as described above, with the plate further including a second region having thickness $T_2$ which is less than $T_1$ and a second channel extending therethrough and having circular cross-section with diameter D. The bottom surface of the plate is complementary to the reference surface (and alignment keys of the cartridge, if present) in a second orientation such that the channel in the second region of the plate overlies the access port in the cartridge when the bottom surface of the plate is matched with the reference surface (and alignment keys) of the cartridge. The length L1 of the elongated member of the plunger is great enough so that the elongated member may be positioned to extend through the second region of the plate and into the port sufficiently far to dislodge a plug in the access port of a sealed cartridge, thereby penetrating the seal therein. In other words, the length L1 of the elongated member of the plunger exceeds the sum of the thickness $T_2$ of the second region and the distance d along which the port extends into the cartridge, minus half the diameter D of the spherical plug. Again, with other shaped plugs, the length L1 is selected, in conjunction with $T_2$, so that the same functional relation exists.

In still another aspect, the invention provides for a kit as described above, in which the diameter of the channels in the plate may vary throughout their respective lengths, provided the diameters have a maximum value of D at the bottom surface of the plate, thereby ensuring that a plug with a maximum diameter on the order of D may be frictionally engaged in those channels.

In still another aspect, the invention provides a method for opening, refilling and resealing a cartridge as described above. The method comprises the steps of providing a plunger and plate as described above, the plate including a plug as described above nominally inserted into the first channel. The sealed port in the cartridge is opened by inserting the elongated member of the plunger into the port to drive the plug out of the access port and into the ink reservoir. The cartridge may then be refilled through the access port with a dispensable ink. The bottom surface of the plate is then matched to the reference surface (and alignment keys of the cartridge, if any) to align the first channel of the plate with the access port in the cartridge. The cartridge is sealed by insertion of the elongated member of the plunger into the first channel of the plate from the top surface until the shoulder of the plunger shank meets the top surface, thereby pushing the plug from the channel in the plate into the access port in the cartridge. The plunger is then withdrawn from the plate and the plate removed from the cartridge.

In still another aspect, the invention provides for a method as described above, with the plate having a second region with thickness $T_2$ being less than thickness $T_1$ in the first region and where $L1>T_2+d-D/2$. The bottom surface of the plate is first matched to the reference surface (and alignment keys of the cartridge, if any) in the so-called second orientation to align the second channel of the plate with the sealed access port in the cartridge. The access port is opened by insertion of the elongated member of the plunger into the port through the second channel in the plate until the shoulder of the plunger shank meets the top surface of the plate so that the plug is driven out of the access port and into the ink reservoir. The plunger is then withdrawn and the plate removed from the cartridge. The cartridge is then refilled through the access port with ink. The bottom surface of the plate is then matched to the reference surfaces (and alignment keys of the cartridge, if any) in the so-called first orientation to align the first channel in the plate with the access port in the cartridge. The elongated member of the plunger is then inserted into the first channel of the plate from the top surface until the shoulder of the plunger shank meets the top surface of the plate, thereby pushing the plug from the channel in the plate into the access port in the cartridge, thereby sealing it. The plunger is then withdrawn from the plate and the plate removed from the cartridge.

These and other features of the invention will be more fully appreciated with reference to the following detailed description which is to be read in conjunction with the attached drawings.

BRIEF DESCRIPTION OF THE DRAWINGS

FIG. 9 shows a perspective view of the cartridge of FIG. 1B with the plate of FIG. 2B in place on the cartridge; and FIG. 10 is a perspective view of another kit according to the invention.

DETAILED DESCRIPTION OF THE INVENTION

The invention provides a kit for opening, refilling and sealing a cartridge of the type used in ink jet printers, where such cartridges include an internal ink reservoir extending from a sealed ink access port in a cartridge wall. Such cartridges may be effectively recycled if they can be opened, refilled with ink, and resealed. Successful refilling and reuse of an ink jet printer cartridge will therefore depend to some extent on the design of the cartridge and the manner in which it is sealed. The kit and methods of this invention are directed to the opening and sealing of such cartridges constructed with a generally circular cross-section access port and sealed with a plug. Such cartridges may include, for example, access ports that have a smooth cylindrical wall (for seating a plug with an interference fit), or have a norminally cylindrical wall with a peripheral groove (for seating a plug), or have a nominally cylindrical wall with one or more peripheral lips (for seating a spherical plug) or have a nominally cylindrical wall with mechanical structures extending inward from the wall (for seating a plug).

Two ink jet printer cartridges particularly suited for use with the kit and methods of the invention are the Hewlett-Packard HP51604A and HP92261A cartridges used in the Hewlett Packard Thinkjet printer and the Hewlett-Packard HP51640 A, C, M, Y and HP51650A cartridges used in the Deskjet 1200C. The kit of the invention is also operative with generally similar cartridges, such as the HP51650C, M and Y cartridges used in Hewlett Packard DesignJet 650C plotters, and cartridges used in the Epson Stylus printer, the Canon BJC600 printer and similar printers. The preferred embodiments described below illustrate the invention in conjunction with two such cartridges, but the invention may be configured with slightly different geometries to accommodate other cartridges.

Figure 1A:
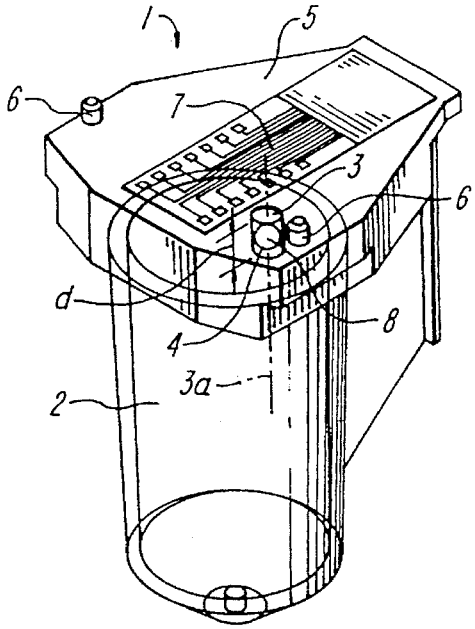
FIG. 1A (PRIOR ART)
FIGS. 1A and 1B are perspective views of two prior art ink jet cartridges.
Figure 1B:
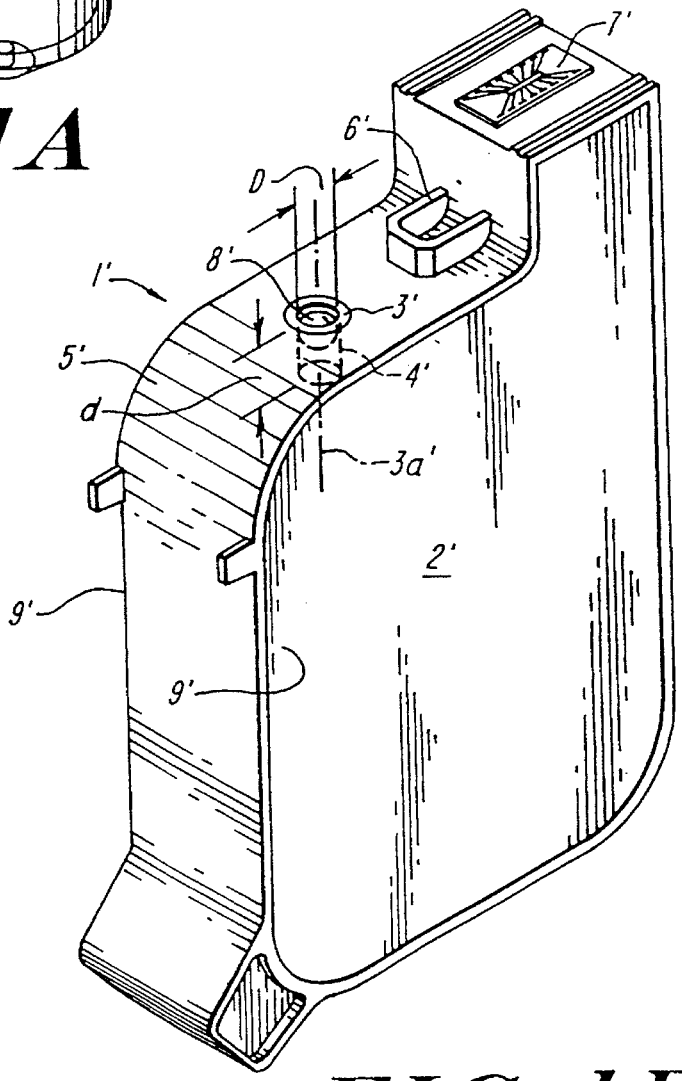
FIG. 1B (PRIOR ART)

FIGS. 1A and 1B show two prior art ink jet printer cartridges which may be opened and sealed with the kits and methods of the invention. In FIG. 1B, elements which correspond to similar elements in FIG. 1A are identified with identical but primed reference designations. A typical cartridge 1 has interior reservoir 2 for containing ink or other dispensable liquid. The interior reservoir 2 is coupled to sealable port 3. The port 3 has a circular cross-section with diameter D and a relatively rigid cylindrical wall 4 extending a distance d into the cartridge along port axis 3*a* and perpendicular to reference surface 5 and one or more alignment keys 6 on the reference surface 5 of the cartridge. The interior surface of the compliant cylindrical wall 4 of the port 3 may be smooth, or it may be textured with, for example, a helical thread pattern. The reference surface 5 of the cartridge 1 is generally notched or otherwise mechanically keyed in order to facilitate placement and proper alignment of the cartridge 1 in a conventional ink jet printer. Various alignment key configurations include pins, projections, notches, keyways and channels. The reference surface 5 may additionally include electrodes 7 which selectively control the release of ink through apertures in the print head. The port 3 is sealed with plug 8. The plug 8 lodges securely in the port 3 and may be a rigid object of any shape, including a sphere, cylinder, conic frustum, or ellipsoid, for example, constructed of a relatively compliant material, which has a diameter slightly greater than D at its widest point. In other forms, cartridges may have channel/plug assemblies with compliant/rigid, compliant/compliant, or rigid/rigid characteristics. The cartridge 1' shown in FIG. 1B is generally similar to that of FIG. 1A and has interior reservoir 2' defined by reference surface 5' and compliant sidewalls 9'. In the illustrated example, the cartridge 1' includes a relatively compliant cylindrical wall 4' and a relatively rigid plug 8'.

Figure 2A:
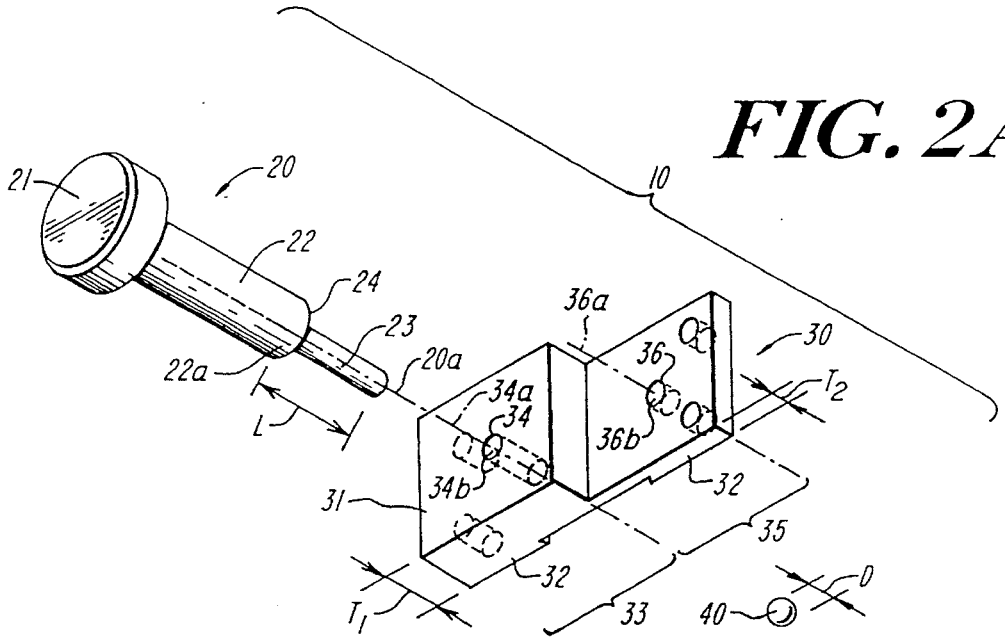
FIGS. 2A and 2B are perspective views of two kits according to the invention.
Figure 2B:
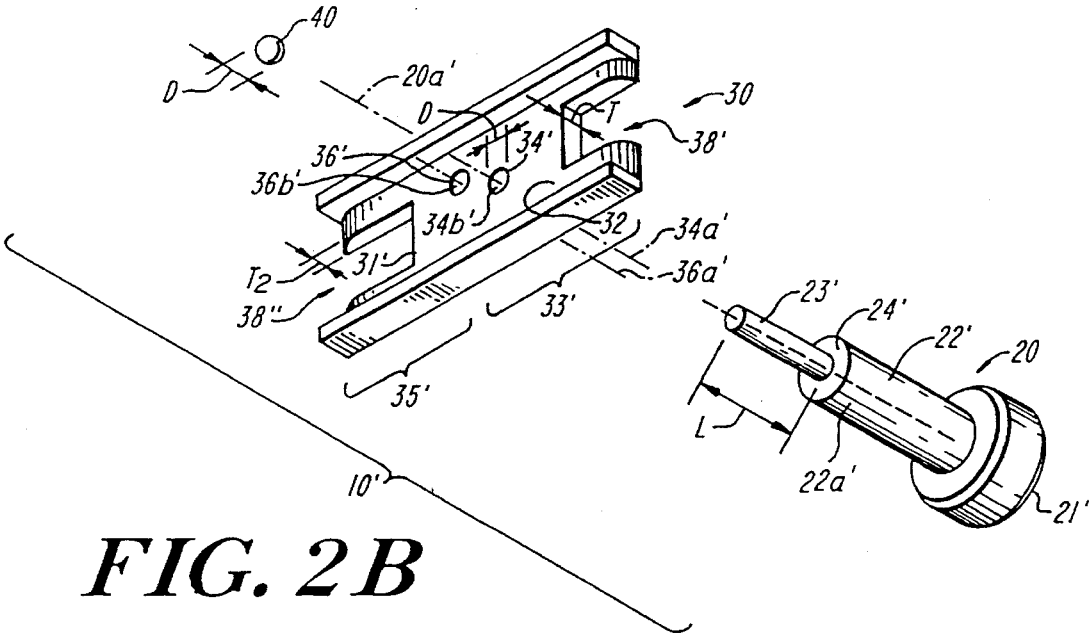

FIGS. 2A and 2B show kits 10 and 10' according to the invention. The kit 10 of FIG. 2A is suitable for use with the cartridge of FIG. 1A. FIG. 2B shows a similar kit 10' for use with the cartridge of FIG. 1B, and is particularly adapted for use in re-filling two of such cartridges. In alterative forms, the plate of FIG. 2B may be configured to fill in N (where N>2) cartridges; for example, two plates may be arranged at right angles and effectively superimposed to provide a four pointed "star" structure for filling four cartridges. In FIG. 2B, elements which correspond to similar elements in FIG. 2A are identified with identical but primed reference designations.

The kit 10 comprises a plunger 20, a plate 30 and a spherical plug 40. The plunger 20 is preferably made of any relatively rigid material and includes a head 21 at one end of the plunger and a shank 22 extending along a plunger axis 20*a* from the head 21. The head 21 is of a size and shape to be conveniently grasped by the user. The shank 22 has a cross-section of any shape where, at the distal end 22*a*, the largest cross-sectional dimension of the shank 22 is greater than D, the diameter of the port 3 in the cartridge 1. An elongated member 23 extends longitudinally from the shank 22 along plunger axis 20*a*. Elongated member 23 has a circular cross-section with a diameter having a maximum dimension less than or equal to D transverse to plunger axis 20*a*. The elongated member 23 extends a distance L1 from the shank 22, which forms a shoulder 24 with elongated member 23 at its point of origin from the shank 22. This plunger design permits extension of the elongated member 23 through a port or ports having a diameter D or greater to a maximum depth L1.

The plate 30 includes top surface 31 and bottom surface 32 and has thickness $T_1$ in a first region 33. A first channel 34 extends through the first region 33 of the plate 30 between the top and bottom surfaces 31 and 32, respectively, along a first channel axis 34*a* perpendicular to the principal plane of the plate 30. The first channel 34 has a circular cross-section and is adapted to hold a plug therein in a friction fit. The channel 34 has a diameter equal to or greater than D at the bottom surface 32 of the plate 30. The channel diameter may be constant between the top and bottom surfaces of the plate 30, or it may vary from the bottom surface 32 to a lesser diameter value away from the bottom surface 32. The first channel 34 is defined by a generally cylindrical wall 34*b* which may have a smooth or textured surface. In the illustrated embodiment, the wall 34*b* is relatively compliant, although in other embodiments (such as ones for use with cartridges having rigid ink access channels and compliant plugs), the wall 34*b* may be relatively rigid.

The bottom surface 32 of the plate is complementary to the reference surface 5 (and also to alignment keys 6) of the cartridge 1; that is, the bottom surface of the plate is preferably constructed to match, or mate with, the reference surface (and alignment keys on the reference surface) of the cartridge. The term "match" or "matching", as used herein, refers to the temporary placement of surfaces adjacent to one another such that the features of the respective surfaces fit together as if they formed a matched pair. More particularly, the bottom surface of the plate is constructed to match the reference surface and alignment keys on the reference surface of the cartridge in a first orientation which matches the first channel in the plate to the access port in the cartridge. In some embodiments, a non-matching surface can be used as long as that surface permits placement of the plate 30 against the reference surface 5 with the respective channels 4 and 34 adjacent and aligned.

Figure 5A:
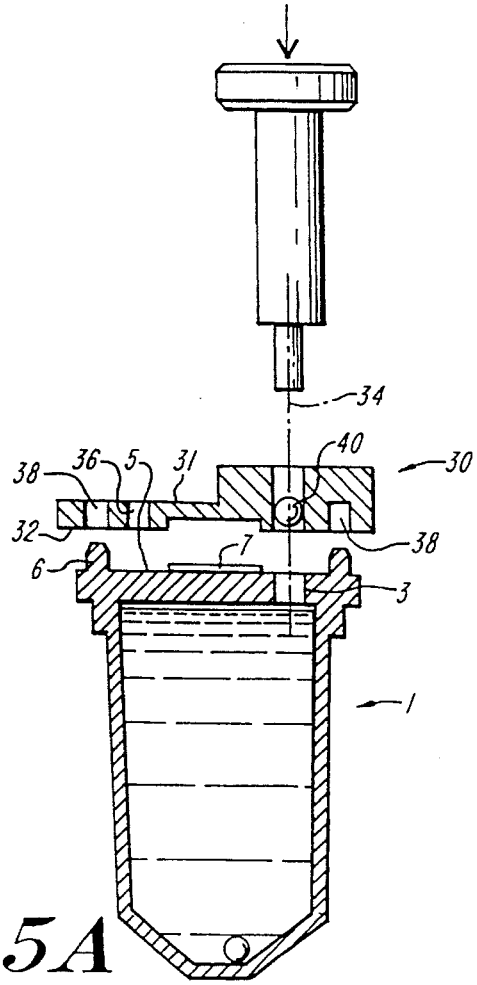
FIGS. 5A–5C are a schematic representation of the sequence of steps used to reseal a refilled cartridge using the kit and method of the invention.
Figure 5B:
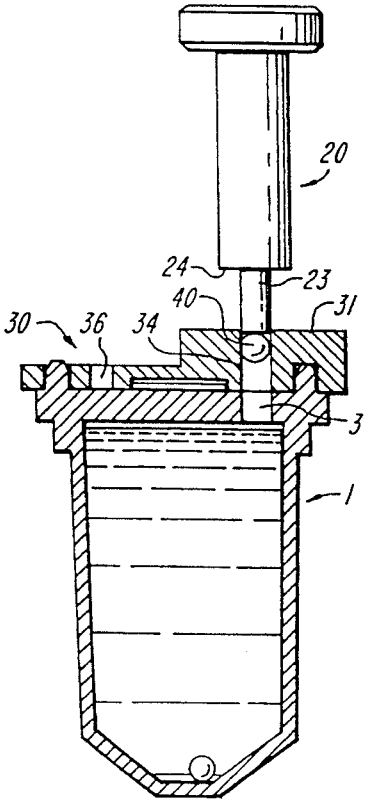
Figure 5C:
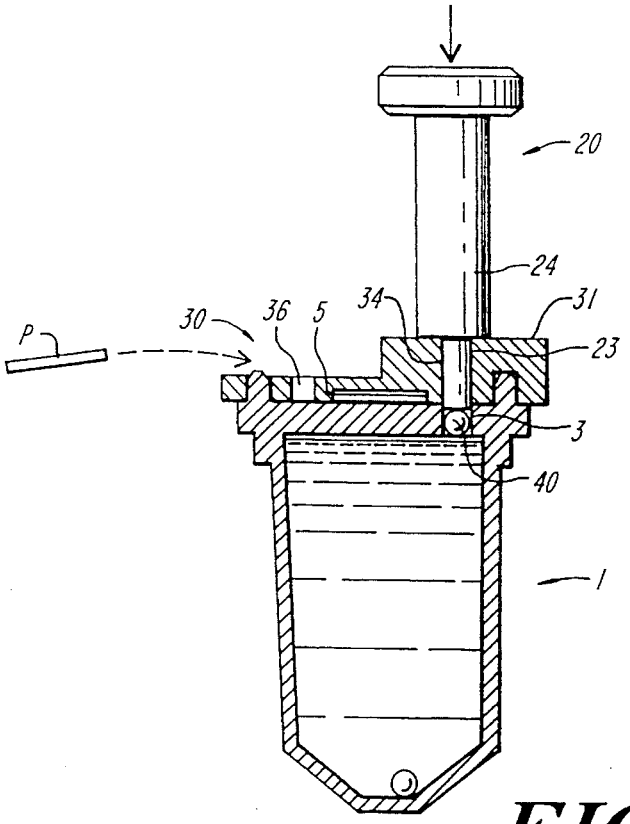

The first orientation is illustrated in FIGS. 5A–5C. When the bottom surface 32 of the plate 30 is matched to the reference surface 5 and alignment keys 6 of the cartridge 1 in the first orientation, the first channel axis 34*a* and the port axis 3*a* are collinear. In the illustrated embodiment, the plate 30 may be constructed of any material which is relatively compliant in comparison to the material used for the spherical plug.

In the illustrated embodiment, the spherical plug 40 included in the kit 10 is constructed of any material which is relatively rigid in comparison with the material from which the cylindrical wall 4 of the port 3 in the cartridge 1 and the cylindrical walls 34*b* of the channels 34 in the plate 30 are constructed. As noted above, in other embodiments the relative rigidity and compliance characteristics may differ. The spherical plug 40 has circular cross-section at its widest point, with a diameter slightly greater than D at its widest point. When the spherical plug is nominally positioned inside a channel in the plate 30 it remains there in a friction, or interference, fit between the plug 40 and the relatively compliant channel walls 34. However, it is not permanently lodged within the channel; it can be dislodged upon the application of nominal force to it, such as by the plunger 20. While the invention is principally described herein with a spherical plug, having a diameter D, it will be understood that other shaped plugs may be used. In the latter form, references to the diameter D of the circular cross-section remain the same for the spherical form; however, where the plug is eccentric with respect to the circular cross-section, the dimension of the eccentricity in the direction perpendicular to the widest point circular cross-section corresponds, to the diameter D in the spherical case, and the relationships defining L1 will be understood to refer to the portion of that dimension of the plug (F) as measured from the widest point cross-section toward the so-called top surface of the plate, with the plug in place in the plate.

Figure 6A:
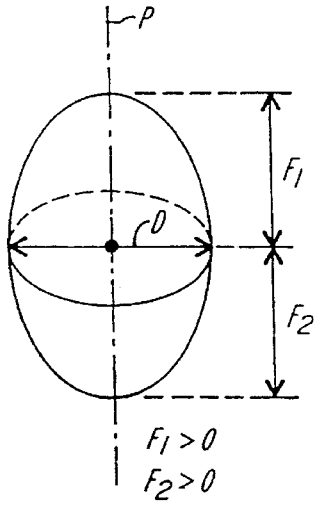
FIGS. 6A–6E illustrate different geometry plugs that may be used with the invention.
Figure 6B:
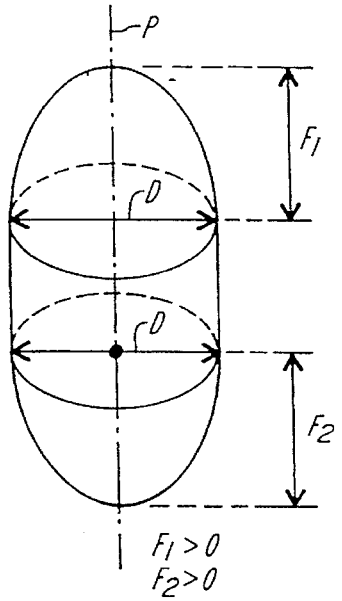
Figure 6C:
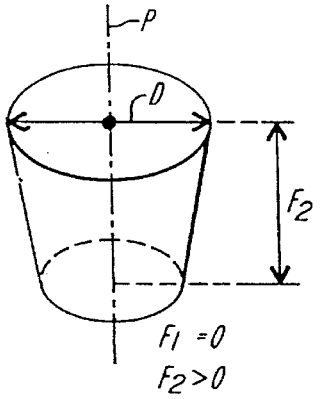
Figure 6D:
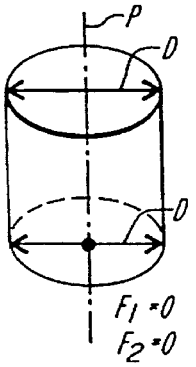
Figure 6E:
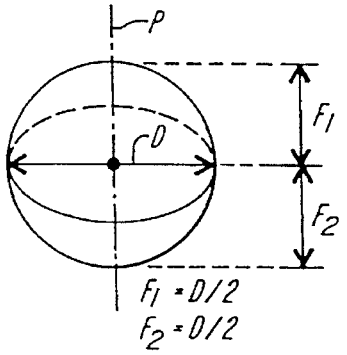

A number of such plugs are illustrated in FIGS. 6A–6E, each plug extending along a plug axis P and having a circular cross-section transverse to axis P with a maximum diameter D at a point between a first end and a second end. FIG. 6A shows an ellipsoid plug; FIG. 6B shows an extended (with a central cylindrical section) ellipsoid plug; FIG. 6C shows a conic frustum plug; FIG. 6D shows a cylindrical plug; and for comparison, FIG. 6E shows a spherical plug. In all of those configurations, the distance F is defined from the one end to the closest circular cross-section with diameter D. In FIGS. 6A and 6B the distance F is greater than zero from either end of the plug; in FIG. 6C, the distance F is zero from the top (as shown) end and is greater than zero from the bottom (as shown) end; in FIG. 6D, the distance F is equal to zero from both the top and bottom ends; and in FIG. 6E, the distance F equals D/2 from each of the top and bottom ends. For these various plugs, the following relationships are contemplated by the invention: $T_1-F<L1<T_1+d-F$ and $L1>T_2+d-F$. The examples below are for the illustrated spherical plug where F=D/2.

Figure 7:
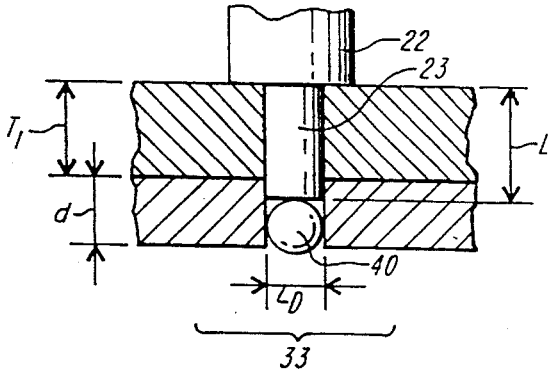
FIGS. 7 and 8 are schematic representations of the spatial relationships between a cartridge and the kit described herein used in accordance with the kits and methods of the invention.

As FIG. 7 illustrates for the spherical plug example, the length L1 of the elongated member of the plunger is greater than the thickness $T_1$ of the first region of the plate minus half the diameter D of the spherical plug, yet less than the sum of thickness $T_1$ and distance d by which the access port extends into the cartridge, minus half the diameter D of the spherical plug. With this relationship between the length of the elongated member of the plunger, the plate thickness in the first region and the diameter of the spherical plug ensures that when the plate is positioned onto the cartridge in the first orientation, as shown in FIG. 7, the elongated member of the plunger extends through the first channel in the plate only far enough into the access port in the cartridge to position a spherical plug in the access port, thereby sealing it. The shoulder of the plunger will not permit the elongated member to extend far enough into the access port to push the spherical plug beyond the distance d by which the access port extends into the cartridge.

While not necessary for the invention, the plate 30 of FIG. 2A further includes a second region 35 having thickness $T_2$, where $T_2$ is less than $T_1$, as shown in FIG. 2A. A second channel 36 extends through the second region of the plate between the top and bottom surfaces along a second channel axis 36*a* perpendicular to the principal plane of the plate. The second channel 36 also has a circular cross-section having diameter greater than or equal to D at the bottom surface 32 of the plate 30. The second channel diameter may also be constant between the top and bottom surfaces of the plate, or it may vary from diameter D at the bottom surface 32 to a lesser diameter value away from the bottom surface. The second channel 36 is also defined by a generally cylindrical wall 36*b* which may have a smooth or textured surface. The second channel 36 has the same compliancy characteristics as channel 34.

Figure 3:
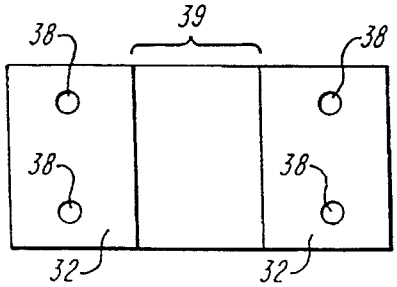
FIG. 3 is a bottom plan view of the bottom surface of plate 30 in kit 10.
Figure 8:
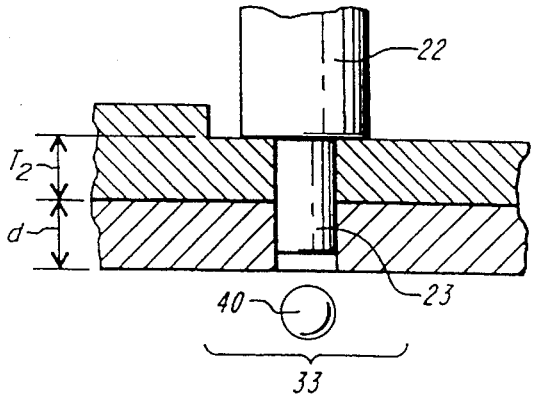

The bottom surface 32 of the plate 30 is shown in plan view in FIG. 3. That bottom surface 32 preferably includes alignment keys 38 (a plurality of holes extending partially or fully therethrough) adapted for complementary engagement with alignment keys 6 of the cartridge 1. A depressed region 39 extends into the bottom surface 32 to provide clearance for the electrode assembly 7 on the cartridge 1. The bottom surface 32 is preferably constructed to match the reference surface 5 and alignment keys 6 on the reference surface 5 of the cartridge 1 in a second orientation (for example, a 180° offset from the first orientation; compare FIGS. 4C and 5A) which matches the second channel 36 in the plate 30 to the access port 4 in the cartridge 1. This second orientation is illustrated in FIG. 8. When the bottom surface 32 of the plate 30 is matched to the reference surface 5 and alignment keys 6 of the cartridge 1 in the second orientation, the second channel axis 36*a* and the port axis 3*a* are collinear. Again, other configurations may be used as long as the plate 30 may be positioned with channel adjacent to and aligned with the access channel 4 of a cartridge.

The length L1 of the elongated member 23 of the plunger 20 is greater than the sum of the thickness $T_2$ of the second region of the plate and the distance d by which the access port extends into the cartridge, minus half the diameter D of the spherical plug. With this relationship between the length of the elongated member of the plunger, the plate thickness in the second region and the diameter of the spherical plug ensures that when the plate is positioned onto the cartridge in the second orientation, the elongated member of the plunger extends through the second channel in the plate sufficiently far into the access port in the cartridge to dislodge a sealing plug therein, as shown in FIG. 8.

As an alternative embodiment, the plate 30' is shown in FIG. 2B, viewed from its bottom surface 32'. This alterative embodiment, adapted for use with the cartridge of FIG. 1B, includes a second region 33' having thickness $T_1$ and a mechanical alignment key 38' adapted to interfit with alignment key 6' of cartridge 1'. A first channel 34' extends through the first region 33' of the plate 30' between the top surface 31' and bottom surface 32' along a second channel axis 34*a'* perpendicular to the principal plane of the plate 30'. The first channel 34' also has a circular cross-section having diameter D at the bottom surface 32' of the plate 30'. The diameter of the first channel 34' may also be constant between the top and bottom surfaces 31' and 32', respectively, of the plate 30', or it may vary from diameter D at the bottom surface 32' to a lesser diameter value away from the bottom surface of the plate. The first channel 34' is also defined by a compliant, generally cylindrical wall 34*b'* which may have a smooth or textured surface. The bottom surface 32' of plate 30' is contoured to be complementary to the reference surface 5' of the cartridge 1' of FIG. 1B with first channel 34' aligned with access port 3'.

Although not necessary for the invention, the plate may be configured with a second channel and plug for use in refilling a second ink cartridge. More particularly, the plate 30' as shown in FIG. 2B includes a second region 35' which includes a second channel 36' extending therethrough along axis 36*a'* with compliant sidewalls 36*b'*, similar to the region 33' of plate 30'. The bottom surface 32' of plate 30' includes a second mechanical alignment key 38" and is contoured to be complementary to the reference surface 5' of another cartridge 1' of FIG. 1B with second channel 36' aligned with access port 3'. When $T_1$ is equal to $T_2$, the plate 30 becomes essentially bilaterally symmetric. The first region 33' and second region 35' of the plate 30', being of equal thickness, may be used interchangeably in positioning a spherical plug in access ports of successively refilled cartridges (following orientation of the plate 30' with the respective cartridges) using the plate 30'.

The length L1 of the elongated member of the plunger is greater than the thickness $T_2$ of the second region of the plate minus half the diameter D of the spherical plug, yet less than the sum of thickness $T_2$ and distance d by which the access port extends into the cartridge, minus half the diameter D of the spherical plug. This relationship between the length of the elongated member of the plunger, the plate thickness in the region 33' and the diameter of the spherical plug ensures that when the plate is positioned onto the cartridge in its so-called first orientation, the elongated member of the plunger will extend through the second channel in the plate only far enough into the access port in the cartridge to position a spherical plug in the access port, thereby sealing it. The shoulder of the plunger will not permit the elongated member to extend far enough into the access port to push the spherical plug beyond the distance d by which the access port extends into the cartridge.

Figure 4A:
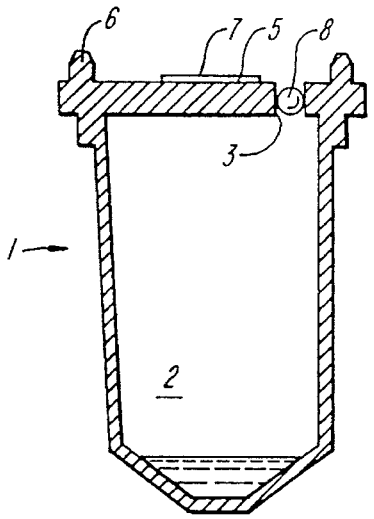
FIGS. 4A–4F are a schematic representation of the sequence of steps used to open and refill a cartridge using the kit and method of the invention.
Figure 4C:
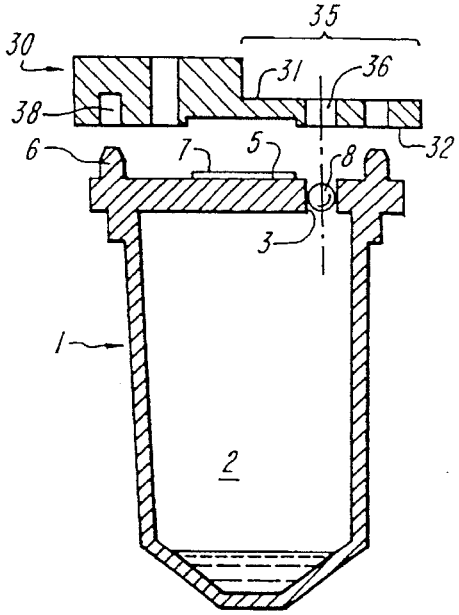
Figure 4B:
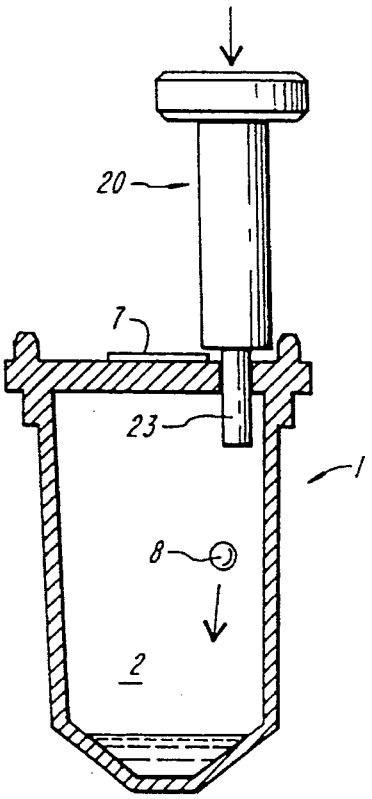
Figure 4D:
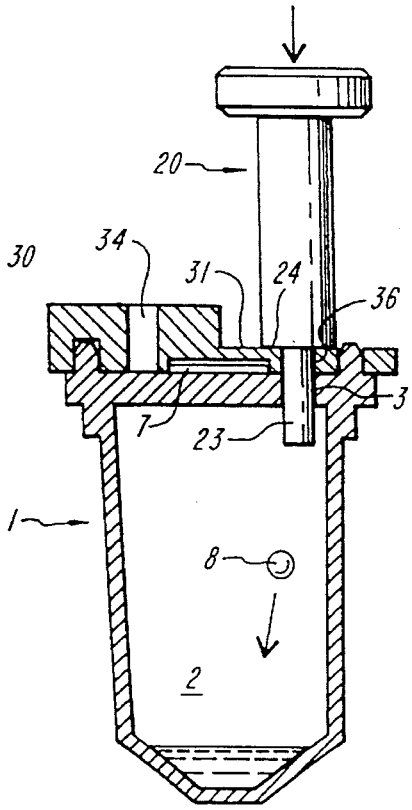

FIGS. 4A–4F and 5A–5C illustrate schematically a method of opening, refilling and sealing a cartridge, shown in FIG. 4A, according to the invention. As shown in FIG. 4B, use of the plate to open the cartridge is optional, since it is merely necessary to extend the elongated member of the plunger into the port sufficiently far to dislodge the sealing plug therein, and this operation may be performed without the plate. However, some ink cartridges, such as the type illustrated in FIG. 1A, contain delicate electrodes 7 on the reference surface 5 which could be damaged if not protected from contact by the plate. In circumstances where protection of the electrodes on the reference surface of the cartridge is desired, the plate may be used as follows to open the sealed access port in the cartridge. As shown in FIG. 4C, the bottom surface 32 of plate 30 is matched to the reference surface 5 and alignment keys 6 of depleted ink cartridge 1 having access port 3 sealed with plug 8 such that the channel axis 36*a* in the second region 35 is collinear with the port axis 3*a*. As shown in FIG. 4D, elongated member 23 of plunger 20 is extended through the second channel 36 in the plate and into the access port 3 until the shoulder 24 of the plunger 20 meets the top surface 31 of the plate 30. Extension of the elongated member 23 to this depth will dislodge the plug 8, thereby sealing access port 3 in the cartridge 1 and releasing the plug 8 into the interior reservoir 2 of the cartridge 1. The plunger 20 may then be withdrawn from the plate 30 and the plate removed from the cartridge 1.

Figure 4E:
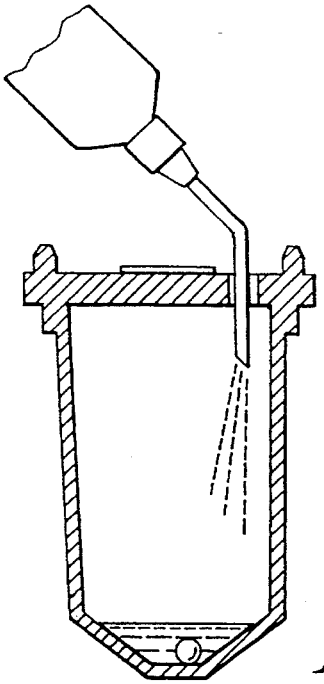
Figure 4F:
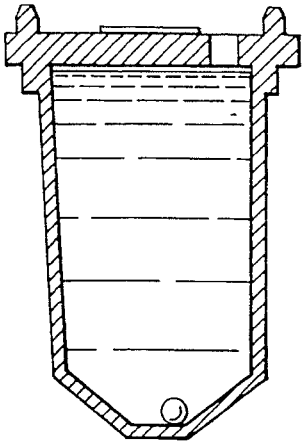

Release of the plug into the interior reservoir of the cartridge does not hinder the flow of ink through the ink jets nor displace significant volume within the ink reservoir, as shown in FIGS. 4E and 4F.

The ink cartridge may then be refilled with a dispensable liquid substance, such as ink, through the open access port in any manner known in the art for refilling cartridges, as shown in FIG. 4E.

The filled cartridge may be resealed using the plate 30 which nominally contains plug 40 positioned within the first channel 34, as shown in FIGS. 5A and 5B. In FIG. 5A, the bottom surface 32 of the plate 30 is matched to the reference surface 5 and alignment keys 6 of the cartridge 1 in a first orientation such that the first channel axis 34*a* is collinear with the port axis; 3*a*. In FIG. 5B the elongated member 23 of the plunger 20 is then inserted from the top surface 31 of the plate 30 through the first channel 34 into the port 3 in the cartridge 1 until the shoulder 24 of the plunger 20 meets the top surface 31 of the plate 30, as shown in FIG. 5C. Extension of the elongated member 23 into the access port 3 to this depth ensures that the rigid spherical plug 40 is pushed into the access port 3, thereby sealing it, but not into the interior reservoir 2 of the cartridge 1. The plunger 20 may then be withdrawn from the plate 30 and the plate removed from the cartridge 1.

By using the present invention, a depleted cartridge may be opened, refilled and resealed instead of discarded after a single use, thereby extending its useful life.

The kit of FIG. 2B may be similarly used to open, fill and reseal the cartridge 1' of FIG. 1B. Initially, the plunger 20' may be used to push the plug 8 into the reservoir 2'. Then, preferably, the lateral walls 9' of the cartridge 1' are nominally squeezed together to pressurize an interior ink storage bladder, for example, and the cartridge 1' is refilled with ink. The bottom surface 32' of plate 30' is then matched to the reference surface 5' of the cartridge 1', as shown in FIG. 9, with alignment keys 6' and 38' aligned, and port 3' and channel 34' aligned. Then the plunger 20' drives the plug 40' in plate 30' into the sealing position in the cartridge wall, completing the method. The plate 30' may then be used in a similar manner (but with channel 36') to refill a second cartridge.

Another kit 10" embodying the invention is shown in FIG. 10, for use with the cartridge of FIG. 1A. In FIG. 10, elements which correspond to elements in FIG. 2A are identified with identical but double primed reference designations. The kit 10" of FIG. 10 includes a plunger having a shank 22" with a first elongated member 23*a"* extending a distance L1 along a first plunger axis 20*a"* from shoulder 24*a"* and a second elongated member 23*b"* extending a distance L2 along a second plunger axis 20*b"* from shoulder 24*b"*. The elongated members 23*a"* and 23*b"* have a maximum cross-section dimension less than or equal to D, and the shoulders 24*a"* and 24*b"* have cross-sections with a maximum dimension greater than D. As illustrated, axis 20*a"* is angularly offset with respect to axis 20*b"*, but those axes may be parallel or co-linear in other forms.

In the kit 10",the plate 30' has a uniform thickness for both channels 34' and 36' (i.e. T1=T2) and the lengths L1 and L2 are selected to clear the access port and seat a plug in that port respectively, when the plate 30' is successively placed in its second and first orientations, respectively. More particularly, $T1-D/2<L1<T1+d-D/2$ and $L2>T2+d-D/2$.

In other embodiments, where the channels 34" and 36" are in differing thickness regions of plate 30'. The lengths L1 and L2 are selected accordingly to effect clearing the access port and seating a plug in that port respectively.

Other alterations to the above-described embodiments will be readily apparent to those ordinarily skilled in the art and are intended to be embraced within the spirit and scope of the invention. That is, the above description is intended as illustrative rather than limiting. The invention is to be defined, therefore, not by the preceding description but by the claims that follow.

We claim:

1. A method for opening, refilling and sealing a cartridge having an interior ink reservoir bounded by a pair of compliant sidewalls and coupled to a sealable access port defined by a nominally cylindrical wall extending from a reference surface of said cartridge, said access port having a nominally circular cross-section with diameter D extending a distance d along a port axis substantially perpendicular to reference surface, comprising the steps of:

A. providing a plunger having a shank, said shank extending along a plunger axis to a shoulder having a transverse cross-section with a maximum dimension greater than D, and having an elongated member extending a length L1 from said shoulder along said plunger axis, said elongated member having a transverse cross-section with a maximum dimension less than or equal to D;

B. providing a plate having a top surface and a bottom surface and having a thickness $T_1$ in a first region and having a first channel extending through said first region along a first channel axis substantially perpendicular to the principal plane of said plate and having a transverse cross-section with a minimum dimension in at least one direction equal to said bottom surface of said plate permitting alignment with said reference surface of said cartridge in a first orientation, said first channel axis being oriented with respect to said bottom surface in said first orientation in the same manner that said port axis is oriented with respect to said reference surface and including plug having a cross-section of diameter D nominally positioned within said first channel, and further including a second region having thickness $T_2$, where $T_2<T_1$, and having a second channel extending through said second region along a second channel axis substantially perpendicular to the principal plane of said plate and having a transverse cross-section with a minimum dimension in at least one direction equal to D, said bottom surface of said plate permitting alignment with said reference surface of said cartridge in a second orientation, said second channel axis being oriented with respect to said bottom surface in said second orientation in the same manner that said port axis is oriented with respect to said reference surface, and including a plug having a cross-section of diameter D nominally positioned within said second channel, wherein $L1>T_2+d-F$ and $T_1-F<L1<T_1+d-F$, and wherein F is the distance from one end of said plug at along its axis to its nearest transverse cross-section having diameter D;

C. aligning said bottom surface of said plate with said reference surface of said cartridge in said second orientation, thereby aligning said second channel with said access port in said cartridge;

D. opening said sealed access port by inserting said elongated member into said second channel of said plate from said top surface until said shoulder meets said top surface, thereby pushing said elongated member of said plunger through said second channel into said port to penetrate the seal therein, and then withdrawing said plunger from said access port and removing said plate from said cartridge;

E. squeezing said sidewalls together to establish a pressure within said ink reservoir;

F. refilling said cartridge with a dispensable liquid substance through said access port;

G. aligning said bottom surface of said plate with said reference surface of said cartridge in said first orientation, thereby aligning said first channel with said access port in said cartridge; and H. sealing said access port in said cartridge by inserting said elongated member into said first channel of said plate from said top surface until said shoulder meets said top surface, thereby pushing said plug into said access port, and then withdrawing said plunger and removing said plate from said cartridge.

2. The method of claim 1 including the further step of:

I. adhering a patch to said reference surface about said access port.

* * * * *